US008209787B2

(12) United States Patent
Rosswaag

(10) Patent No.: US 8,209,787 B2
(45) Date of Patent: Jul. 3, 2012

(54) TOILET SEAT COVER HAVING AIR TREATMENT SYSTEM

(76) Inventor: Thomas Rosswaag, Peterborough, NH (US)

( * ) Notice: Subject to any disclaimer, the term of this patent is extended or adjusted under 35 U.S.C. 154(b) by 657 days.

(21) Appl. No.: 12/356,857

(22) Filed: Jan. 21, 2009

(65) Prior Publication Data

US 2009/0188026 A1 Jul. 30, 2009

Related U.S. Application Data

(60) Provisional application No. 61/023,534, filed on Jan. 25, 2008.

(51) Int. Cl.
*A47K 13/00* (2006.01)

(52) U.S. Cl. ..... 4/217; 4/213

(58) Field of Classification Search ..... 4/213, 217
See application file for complete search history.

(56) References Cited

U.S. PATENT DOCUMENTS

| | | | | |
|---|---|---|---|---|
| 4,344,194 | A * | 8/1982 | Pearson | 4/213 |
| 4,586,201 | A * | 5/1986 | Todd, Jr. | 4/217 |
| 4,853,981 | A * | 8/1989 | Hunnicutt, Jr. | 4/213 |
| 5,539,937 | A * | 7/1996 | Barefoot | 4/213 |
| 6,795,980 | B1 * | 9/2004 | Ries | 4/217 |
| 6,895,604 | B1 * | 5/2005 | Ramsey | 4/213 |
| 2003/0145369 | A1 * | 8/2003 | Hunnicutt et al. | 4/217 |
| 2003/0187412 | A1 * | 10/2003 | Martin | 604/359 |

* cited by examiner

*Primary Examiner* — Gregory Huson
*Assistant Examiner* — Karen L Younkins
(74) *Attorney, Agent, or Firm* — Davis & Bujold, P.L.L.C.

(57) ABSTRACT

A toilet seat cover for a toilet having an internal compartment located within the toilet seat cover and an inlet aperture located in a bottom surface of the toilet seat cover. A filtration component is accommodated within the internal compartment and an air moving device for drawing in air from the toilet into the internal compartment and directing the air through the filtration component such that as the air passes through the filtration component, any noxious air, fumes and toilet odors in the air are removed prior to the treated air being discharge, from a discharge outlet of the toilet seat cover, into the surrounding environment.

19 Claims, 6 Drawing Sheets

TOILET SEAT COVER HAVING AIR TREATMENT SYSTEM

FIELD OF THE INVENTION

The present invention relates to a method and an apparatus for removing noxious air, fumes and toilet odors which escape from a toilet during use thereof and recycling the air back into the room, accommodating the toilet, once a substantial portion, if not all, of the noxious air, fumes and odors have been removed from the air.

BACKGROUND OF THE INVENTION

Toilet odor venting systems are widely known. Typically these systems take the form of an exhaust fan mounted in the ceiling or wall of a bathroom. The exhaust fan could also be mounted to the interior or exterior of a barrier enclosing a toilet such as a "port-a-potty" or other portable type bathroom facility.

The exhaust fans of these venting systems are arranged such that, when activated, the fans conduct air and toilet odors away from the interior of the bathroom. Typically these exhaust fans communicate with some type of duct or other such air guidance means which convey the air from the bathroom to an exterior of the house or other building.

In use, when an individual enters the bathroom and desires to remove any noxious air, fumes and/or toilet odors, that individual will turn on the exhaust fan of these venting systems by actuating the switch of any electrical circuit. Once energized, the exhaust fans begin to rotate thus directing the noxious air, fumes and/or toilet odors from the interior of the bathroom through the duct to the exterior of the house. Such venting, however, has the associated drawback, especially in cold weather climates, of removing heat from the house or building.

This type of venting system is effective in removing toilet odor from the interior of the bathroom, however. it also has some shortcomings. One major drawback of this venting system is that the exhaust fans are remote from the toilet. Because of this, toilet odors need to pass from the toilet bowl into the interior of the bathroom before being vented by the venting system out of the bathroom and into the exterior environment.

The length of time it takes to remove the toilet odor from the bathroom depends upon the size of the bathroom and upon the volume of air that the exhaust fan is capable of moving. In general, exhaust fans are fairly small and do not convey much air. This typically results in the toilet odors lingering in the bathroom for an unnecessarily extended period of time.

A further drawback of these venting systems is that in some applications it is not feasible to directly vent the noxious air, fumes and toilet odors from a bathroom to the exterior environment due to a variety of factors such as the location of the bathroom within the house or other building, the building construction, etc. Further, the design of the walls and ceiling often times make it difficult to implement these venting systems.

SUMMARY OF THE INVENTION

Wherefore, it is an object of the present invention to overcome the above mentioned shortcomings and drawbacks associated with the prior art.

Another object of the present invention is to provide a venting system in close proximity to the toilet such that noxious air, fumes and toilet odors are directly vented from the toilet and filtered before exhausting such air back directly into the bathroom.

Yet another object of the present invention is to provide a method and an apparatus which removes noxious air, fumes and odors, escaping from a toilet, so that such air can be treated, recycled and discharged directly into the surrounding environment accommodating the toilet.

A further object of the present invention is to provide a miniature fan control system in combination with a filter arrangement which both cooperate with one another to draw in noxious air, fumes and odors from a toilet, pass the noxious air, fumes and odors through the filter member and then directly discharge the treated and refreshed air directly into the surrounding environment.

The present invention also relates to a toilet seat cover for a toilet comprising: an internal compartment located within the toilet seat cover; an air inlet aperture being provided in a bottom surface of the toilet seat cover; a filtration component being accommodated within the internal compartment; an air moving device for drawing in air from the toilet into the internal compartment and supplying the drawn in air to the filtration component such that as the air passes through the filtration component, noxious odors in the air are removed prior to the air being discharge from a discharge outlet of the toilet seat cover into the surrounding environment.

BRIEF DESCRIPTION OF THE DRAWINGS

The invention will now be described, by way of example, with reference to the accompanying drawings in which.

DETAILED DESCRIPTION OF THE INVENTION

Figure 1:
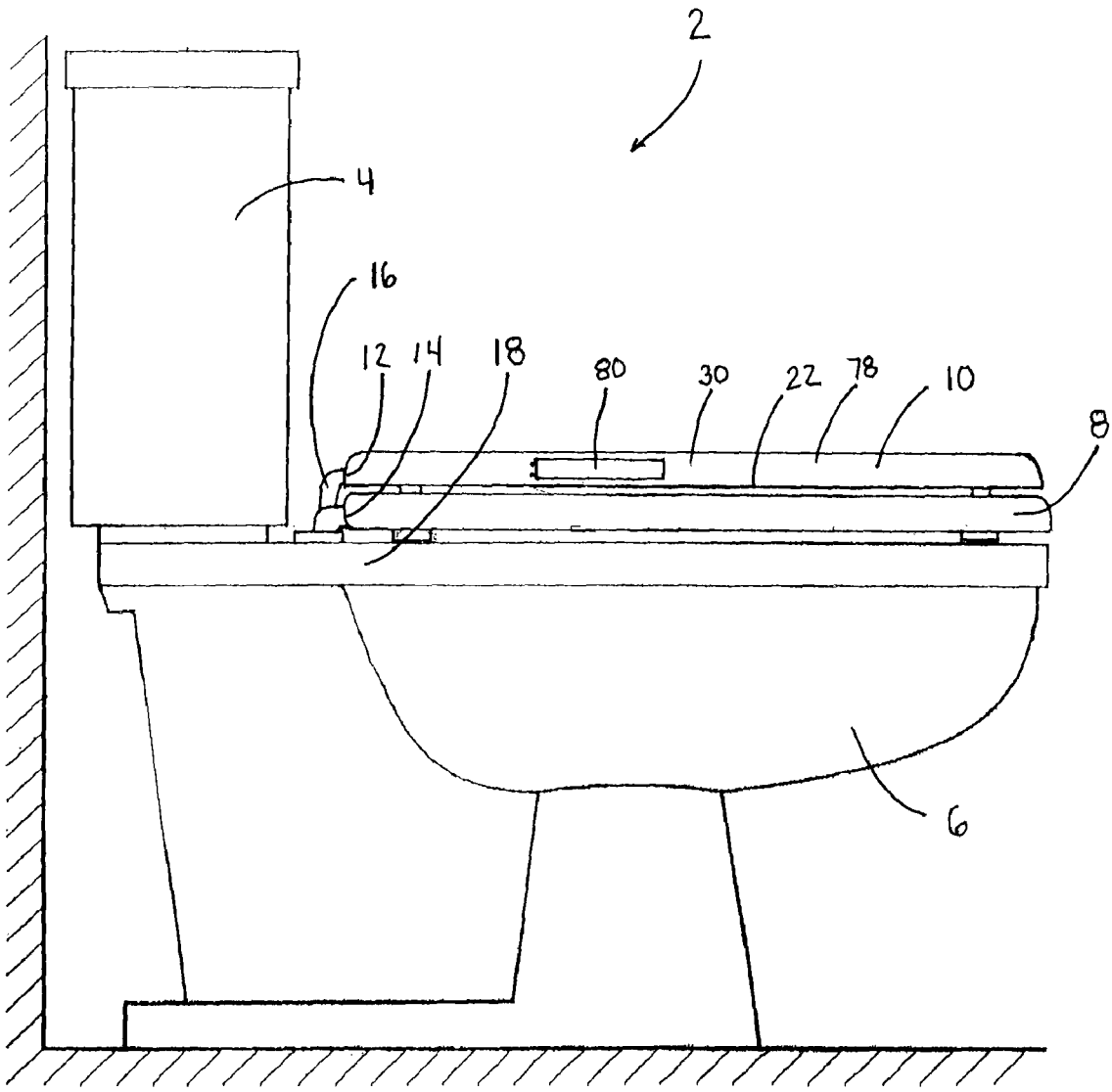
FIG. 1 is a diagrammatic side elevation view of toilet having a toilet seat cover according to the present invention.
Figure 2:
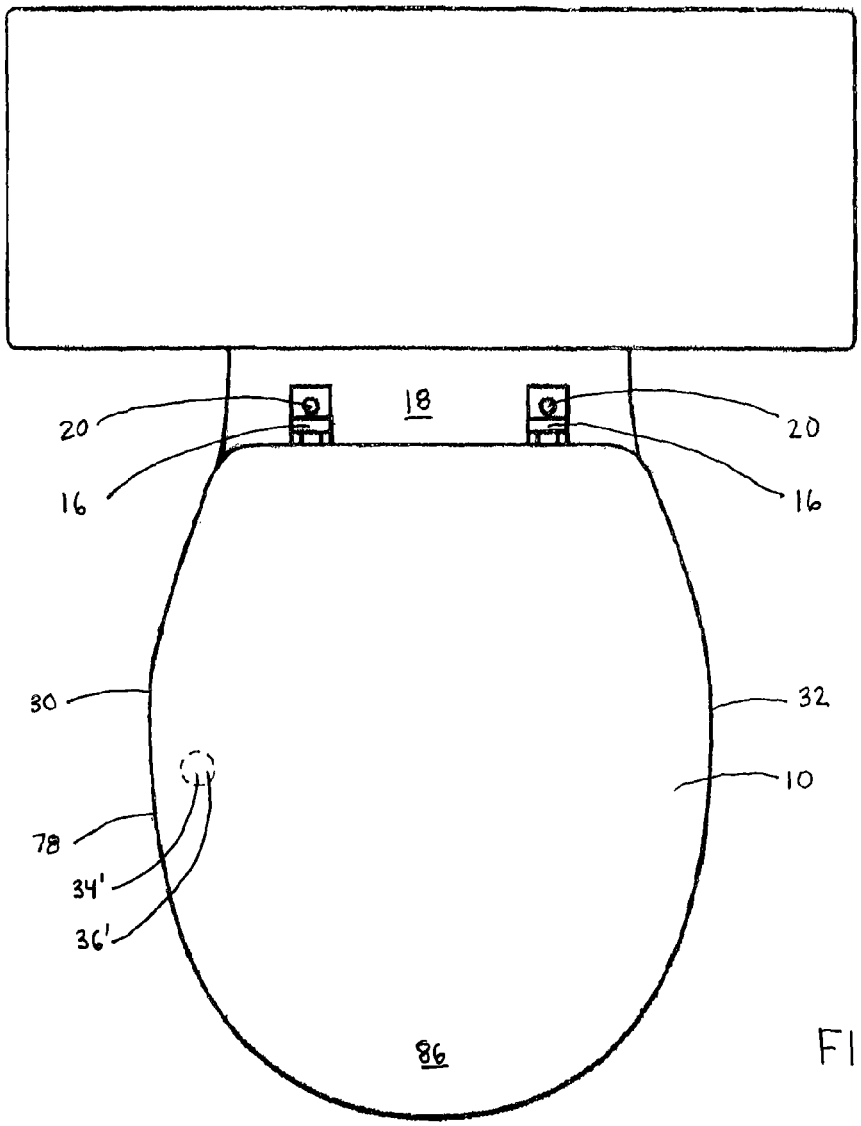
FIG. 2 is a top plan view thereof
Figure 3:
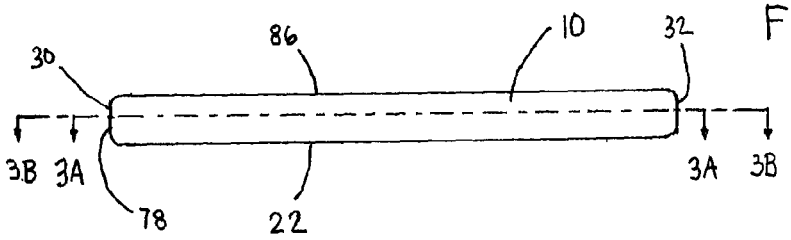
FIG. 3 is a front elevation view of only the toilet seat cover of FIG. 2.

Turning now to FIGS. 1-3, a brief description concerning the various components of the present invention will now be briefly discussed. As can be seen in FIG. 1, a conventional toilet 2 is shown and this toilet 2 includes a water storage tank 4, a toilet bowl 6, a toilet seat 8, and a toilet seat cover 10 incorporating the air treatment system according to the invention. A further discussion concerning the air treatment system will be provided below.

Figure 3A:
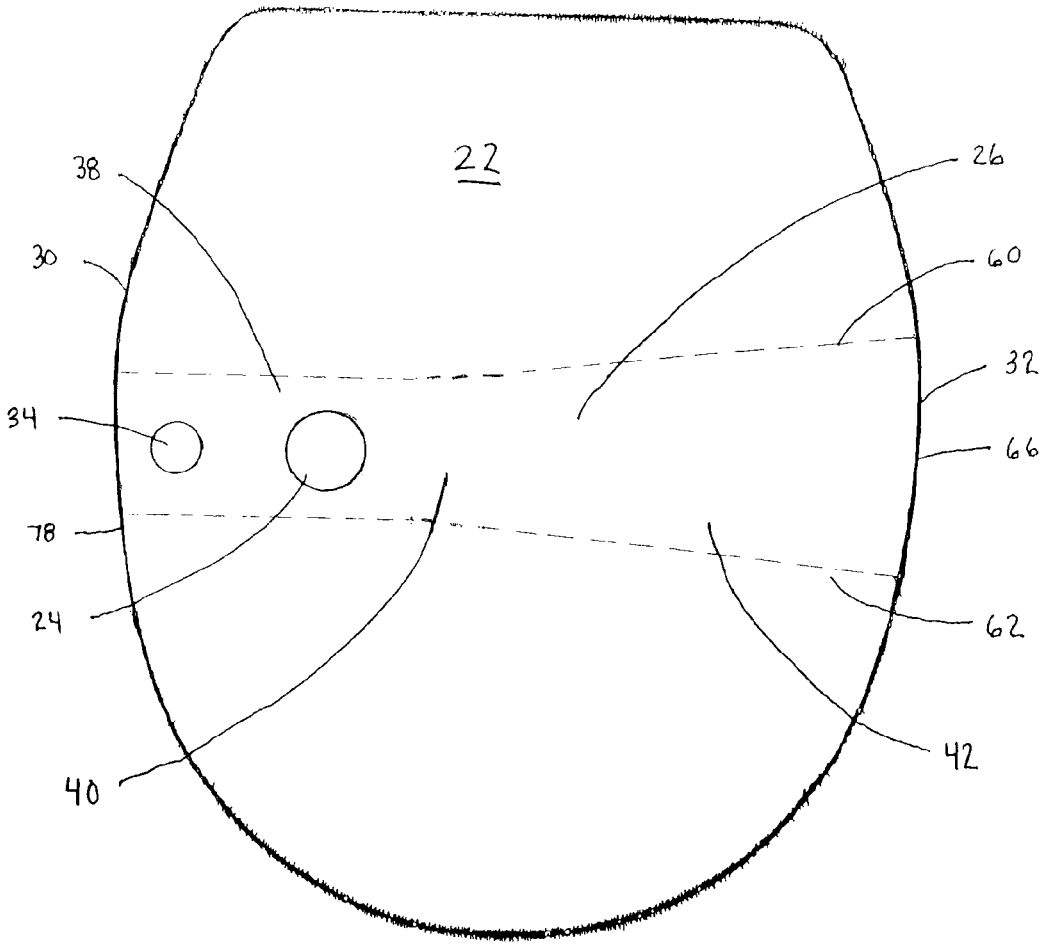
FIG. 3A is a diagrammatic cross-sectional view of the toilet seat cover, along section line 3A-3A of FIG. 3, prior to installation of the air intake device and the filtration component.

As can be seen in FIGS. 1 and 2, both the toilet seat 8 and the toilet seat cover are secured to a rim 18 of the toilet bowl 6 in a conventional manner. That is, the bottom and/or rear surfaces 12, 14 of each the toilet seat 8 and the toilet seat cover 10 are affixed or connected to a pair of spaced apart of hinges 16 and each of the spaced apart hinges 16 is, in turn, secured to the rim 18 of the toilet bowl 6 by one or more conventional fasteners 20, such as screws, bolts and nuts, etc. The hinges 16 facilitate pivoting movement of the toilet seat 8 and the toilet seat cover 10 with respect to the toilet bowl 6 as well as with respect to one another. As is conventional, both the toilet seat 8 and the toilet seat cover 10 can be pivoted into either a substantially vertical position or a substantially horizontal position. As such components and their function are conventional and well known in the art, a further detail description concerning the same will not be provided Turning now to FIGS. 3A-8, the air treatment system according to the present invention will now be described in further detail. As can be seen in FIG. 3A, the bottom surface 22 of the toilet seat cover 10 is provided with an air inlet aperture 24 which allows noxious air, fumes and toilet odors to be sucked or drawn into an internal compartment 26 of the toilet seat cover 10, from the toilet bowl 6, and passed along and through the air treatment system and before finally being discharged directly into the surrounding environment. Further, the bottom surface 22 of the toilet seat cover 10 is also provided with an switch access aperture 34.

Figure 3B:
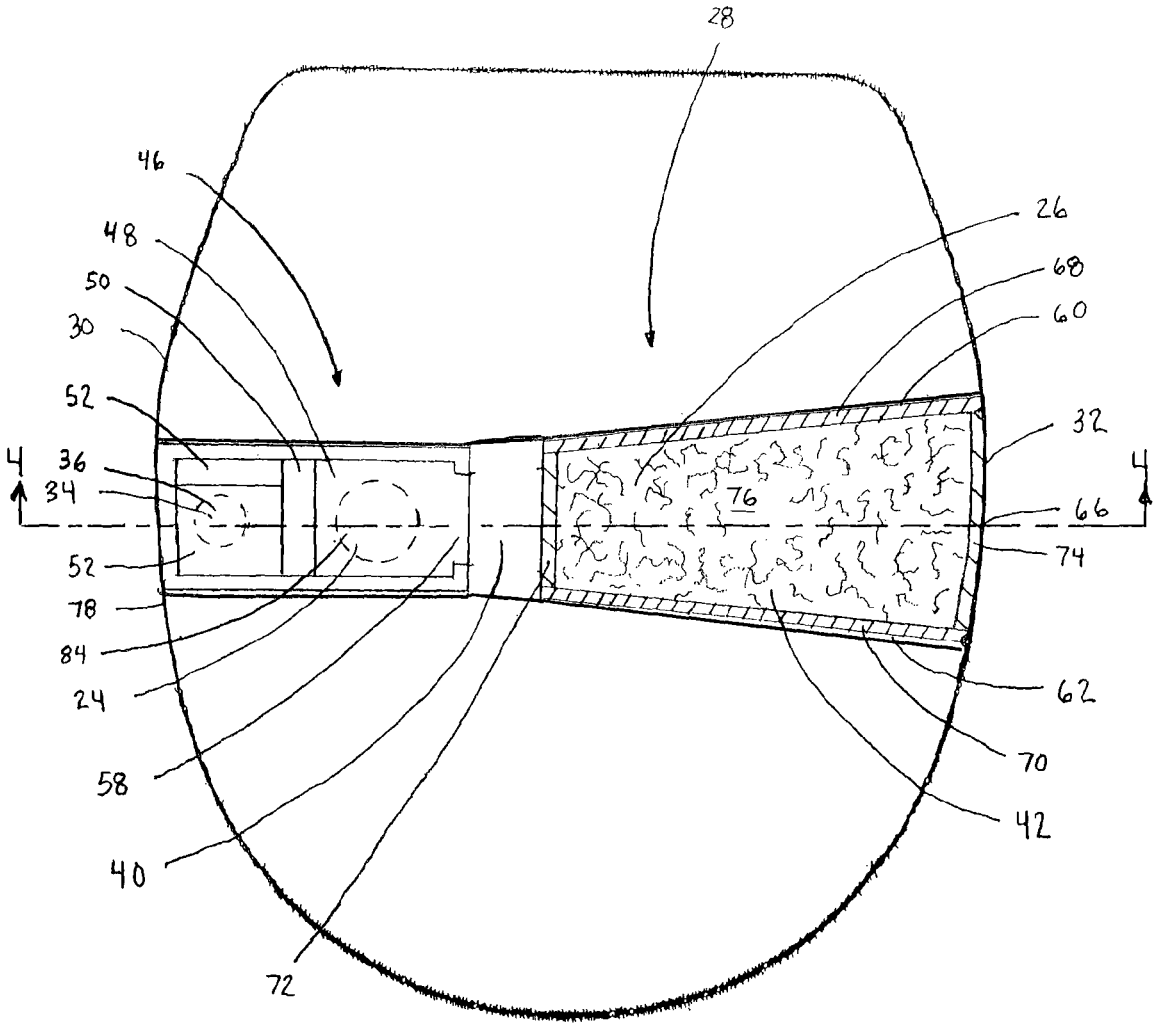
FIG. 3B is a diagrammatic cross-sectional view of the toilet seat cover of FIG. 3A following installation of the air intake device and the filtration component.
Figure 4:
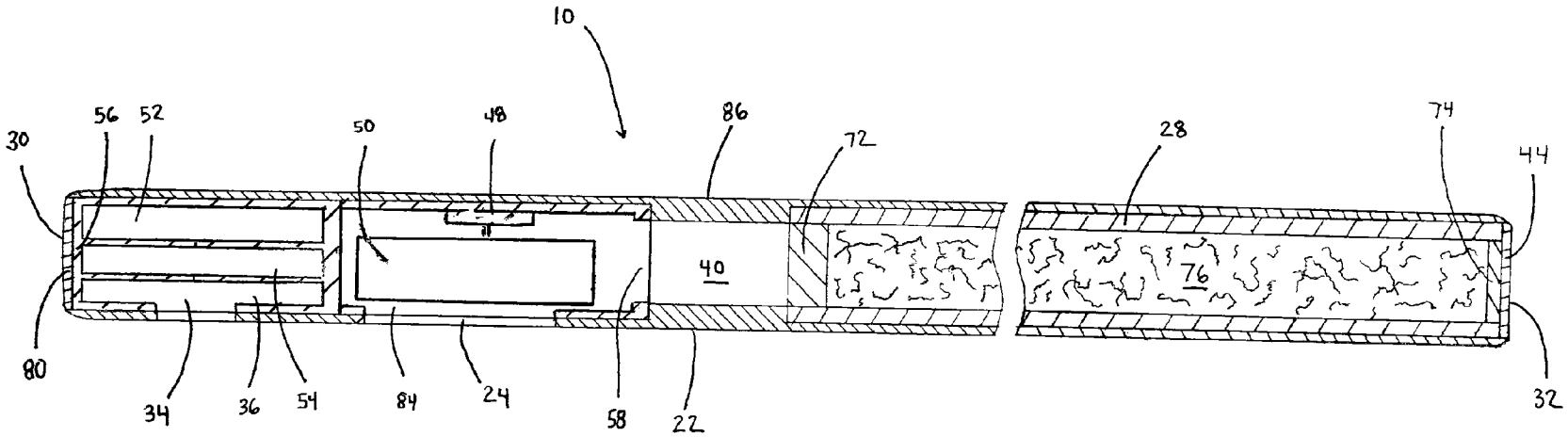
FIG. 4 is a diagrammatic cross-sectional view of the toilet seat cover along section line 4-4 of FIG. 3B.
Figure 5:
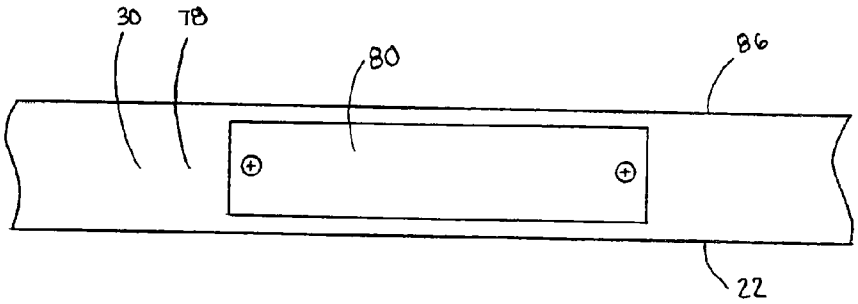
FIG. 5 is diagrammatic side elevation view showing an air permeable panel covering an air discharge outlet of the filtration chamber.

As can be seen in FIGS. 3A, 3B and 4, for example, the internal compartment 26 of the toilet seat cover 10 extends from a first lateral side wall 30 of the toilet seat cover 10, having an access port 56 formed therein, to an opposite second lateral side wall 32 of the toilet seat cover 10, having an air discharge outlet 66 formed therein. The internal compartment 26 generally comprises an air intake chamber 38 and an air filtration chamber 42 with a centrally located internal passageway 40 interconnecting the air intake chamber 38 with the air filtration chamber 42. The air intake chamber 38 accommodates a removable air intake device 46 while the air filtration chamber 42 accommodates a removable filtration component 28.

The filtration chamber 42 extends from the internal passageway 40 to the air discharge outlet 66 and the opposed side walls 60, 62 of the filtration chamber 42 preferably flare away from one another from adjacent the internal passageway 40 toward the second lateral side wall 32 of the toilet seat cover 10. The height of the filtration chamber 42 is about ⅞ of an inch or so. Over a length of about 7 inches or so, the spacing of the side walls 60, 62 of the filtration chamber 42 from one another gradually increases or flares from a spacing of about 2⅜ inches, adjacent the internal passageway 40, to a spacing of about 3⅞ inches adjacent the air discharge outlet 66. The removable filtration component 28, e.g., a charcoal filter, is accommodated within the filtration chamber 42 and the exterior surface of the removable filtration component 28 generally forms a fluid tight seal with the internal surfaces of the filtration chamber 42 so that the air to be treated must generally pass through a filter material 76 contained within the filtration component 28.

The air discharge outlet 66, formed in the second lateral side wall 32 of the toilet seat cover 10, allows treated air to be exhausted from the internal compartment 26. A removable air permeable panel 44 covers the air discharge outlet 66 and this panel assists with captively retaining the filtration component 28 within the filtration chamber 42. When the air permeable panel 44 is removed from the air discharge outlet 66, access is provided to the filtration component 28 and this facilitates servicing and/or changing of the filtration component 28.

Figure 8:
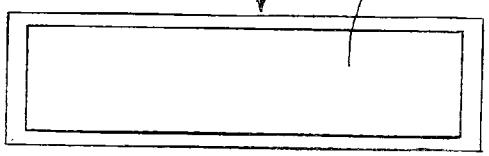
FIG. 8 is a schematic view showing the features of the air intake device.
Figure 7:
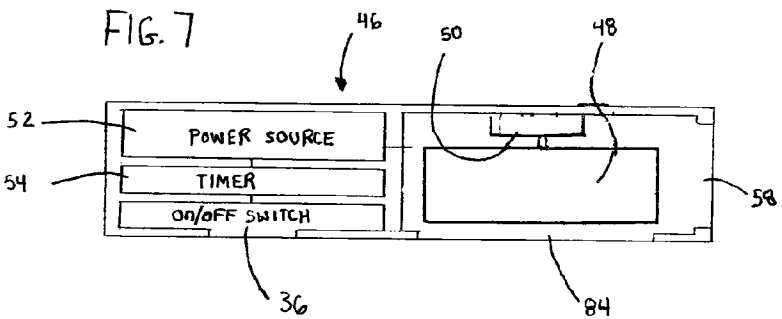
FIG. 7 is diagrammatic side elevation view showing a removable access panel covering an access port to an air intake chamber.

As schematically shown in FIG. 8, the air intake device 46 generally comprises an internal air moving device 48, such as a fan, a turbine or a blower for example, and an exterior on/off switch 36. When the air intake device 46 is installed within the air intake chamber 38, an air inlet 84 of the air intake device 46 is aligned with the air inlet aperture 24 while the on/off switch 36 is aligned with the on/off switch access aperture 34 provided in the toilet seat cover 10. An air exhaust outlet 58, of the air intake device 46, is aligned with the internal passageway 40 for directing the air, sucked into the air intake device 46, along the internal passageway 40 and through the filtration component 28 located within the filtration chamber 42. As the air passes through the filter material 76 contained within the filtration component 28, any noxious air, fumes and odors contained within the air to be treated are removed by the filter material 76 prior to the air being discharged, through the air permeable panel 44 covering the air discharge outlet 66, into the surrounding environment.

It should be appreciated that although the on/off switch 36, 36' and associated access aperture 34, 34' are shown on the bottom surface 22 of the toilet seat cover 10, those features may be also located on the top surface 86 or one of the side surfaces of the toilet seat cover 10 or even remotely from the toilet seat cover 10.

The air intake device 46 includes a motor 50 driving the air moving device 48 as well as a power source 52 for supplying electrical power to the motor 50. The components are coupled to one another by conventional wiring. In a preferred embodiment, the power source 52 is at least one conventional battery (e.g., 3 double AA batteries) which facilitates supplying electrical power to the motor 50 of the air intake device 46. Once the electrical power of the at least one battery is substantially consumed, the battery is replaced in a conventional manner.

The electrical power to the motor 50 is turned "on" and "off" when the end user activates the switch 36. If desired, the air intake device 46 may also be equipped with an automatic timer 54 which times operation of the air moving device 48 of the air intake device 46 for a predetermined period of time, e.g., for about two minutes to about 40 minutes, more preferably for about 5 minutes to about 30 minutes, and most preferably for about 7 minutes to about 20 minutes before automatically turning off the supply of electricity to the motor 50.

It is to be appreciated that the air treatment system, according to the present invention, is particularly effective when the toilet seat 8 and the toilet seat cover 10 are both closed after use of the toilet 2, i.e., both the toilet seat 8 and the toilet seat cover 10 are in the horizontal position. Further, operation of the air intake device 46 generally produces an audible or detectable sound so that the end user is normally able to hear the air intake device 46 operating and turn the device "off" after it has been operation for a sufficient period of time, in the event that an automatic timer is not provided.

A removable access panel 80 covers the access port 56 and this panel assists with captively retaining the air intake device 46 within the air intake chamber 38 during use. When the access panel 80 is removed from the access port 56, access is provided to the air intake device 46 and this facilitates removing, cleaning and/or servicing of the air intake device 46, changing of the battery, servicing of the air moving device 48 and/or the motor 50, completely replacing the air intake device 46, etc. The removable access panel 80 may be releasably secured to the access port 56 by a conventional quick connect coupling such as, for example, a pair of convention opposed spring clips supported on opposite ends of the access panel 80, one or more screws, combined a hinge and a latch arrangement, etc.

The air moving device 48 of the air intake device 46 typically will be able to convey or transport a volume of air of between about 2 cubic feet per minute (cfm) to about 30 cubic feet per minute (cfm), more preferably between about 10 cubic feet per minute (cfm) to about 20 cubic feet per minute (cfm), and most preferably between about 11 cubic feet per minute (cfm) to about 18 cubic feet per minute (cfm).

Figure 6:
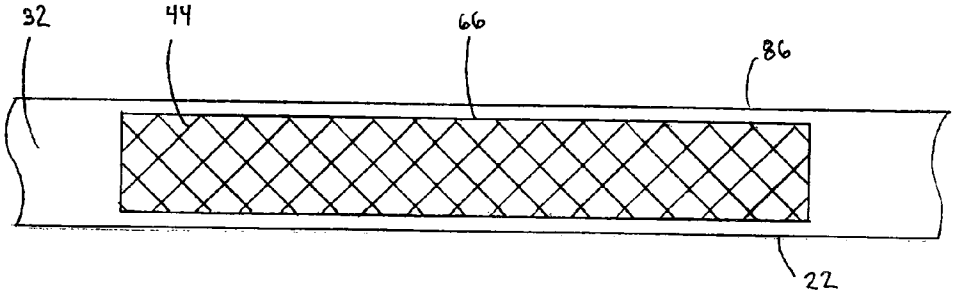
FIG. 6 is a diagrammatic cross-sectional view of the filtration component of FIG. 3B.

As shown in FIGS. 3B, 4 and 6 for example, the filtration component 28 has a shape and/or configuration which closely corresponds to the interior shape and/or configuration of the filtration chamber 42. That is, the side walls 68, 70 of the filtration component 28 generally coincide with and match the flare of the opposed side walls 60, 62 of the filtration chamber 42 such that, once the filtration component 28 is received within the filtration chamber 42, a substantially fluid tight perimeter seal is achieved between the exterior surface of the filtration component 28 and the interior surfaces of the filtration chamber 42. The filtration component 28 generally includes at least an air permeable leading surface 72 as well as an air permeable trailing surface 74. The air permeable leading surface 72 and the air permeable trailing surface 74 can be manufactured from a variety of different materials, such as screen, cloth or foam. The important aspect of the air permeable leading surface 72 and air permeable trailing surface 74 is that these surfaces permit the air to be treated to pass through the filter material 76, contained within the filtration component 28, for adequately treating the air prior to discharging the air through the discharge outlet 66.

The filter material 76 is preferably an activated charcoal having the following properties. The activated charcoal should have a high-microporous content and as high an internal surface area as possible. Activated charcoal, having surface areas of between about 300 and about 2,000 square meters per gram, is preferred. As is known, a high surface area of activated charcoal provides the charcoal with countless sites at which certain chemicals can attach and are thereafter be bound.

Operation

When operation of the air treatment system is desired, the operator will activate the air intake device 46 by depressing the on/off button or switch 36. Such activation will, in turn, activate the supply electrical power from the power source 52 to the motor 50. The motor 50 drives the air moving device 48 which operates to suck or draw in noxious air, fumes and toilet odors, from the toilet bowl 6, through the air inlet aperture 24 of the toilet seat cover 10 and the air inlet 84 of the air intake device 46. The drawn in air is then conveyed by and discharged out through the air exhaust outlet 58 of the air intake device 46 such that the discharged air, carrying the noxious air, fumes and toilet odors, is conveyed along the internal passageway 40 toward the filtration component 28 located within the filtration chamber 42.

As the convey air, carrying the noxious air, fumes and toilet odors, enters the air permeable leading surface 72 and then passes and/or flows through the filter material 76 of the filtration component 28, located within the filtration chamber 42, where the noxious air, fumes and toilet odors, are removed from the air by the filter material 76, i.e., the air is "treated" as the air passes and/or flows through the filter material 76 of the filtration component 28. The treated air eventually exits the filter material 76 and the air permeable trailing surface 74 and this treated air finally passes through the removable permeable panel 44, covering the discharge outlet 66 formed in the second lateral side wall 32 of the toilet seat cover 10, and is exhausted directly into the surrounding environment. As the air passes through the filter material 76, the noxious air, fumes and toilet odors bind to the countless sites in the filter material and/or are absorbed and removed from the air so that the treated air, once it is eventually discharged from the toilet seat cover 10, is substantially free from any noxious air, fumes and toilet odors.

A suitable air moving device, for example, is a portable fan which is sold under the trademark "ifan™" by O2 Cool, a division of GLI, LLC of Chicago, Ill. This lightweight, completely self contained, fan is operated by three AA batteries and the entire completely self contained fan is sized to be easily accommodated within the interior space of the air intake chamber. Preferably the air moving device has a close fit with the interior space of the air intake chamber, or possibly accommodates a suitable packing material, to minimize movement of the air moving device during raising and/or lowering movement of the toilet seat. It is to be appreciated that other conventional fans and/or blowers, having the desired air moving properties and features, would also be suitable for use with the present invention.

Since certain changes may be made in the above described improved air treatment system and method, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, I claim:

1. A toilet seat cover for a toilet comprising:

an internal compartment located within the toilet seat cover;

an air inlet aperture being provided in a bottom surface of the toilet seat cover for receiving air directly from an interior of a bowl of the toilet;

a filtration component being accommodated within the internal compartment;

an air moving device for drawing in air directly from the interior of the bowl of the toilet into the internal compartment and supplying the drawn in air to the filtration component such that as the air passes through the filtration component, noxious odors in the air are removed prior to the air being discharged from a discharge outlet of the toilet seat cover into the surrounding environment wherein the internal compartment comprises an air intake chamber and an air filtration chamber and a passageway interconnecting the air intake chamber with the filtration chamber, the air inlet aperture communicates with the air intake chamber, such that between the interior of the bowl of the toilet and the air intake chamber, the air solely passes through the air inlet aperture and the air filtration chamber communicates with the discharge outlet, and the filtration component is accommodated within the air filtration chamber.

2. The toilet seat cover according to claim 1, wherein the filtration chamber increases in transverse cross sectional area from adjacent the passageway toward the discharge outlet.

3. The toilet seat cover according to claim 1, wherein a spacing of opposed side walls of the filtration chamber flare away from one another from adjacent the passageway toward the discharge outlet.

4. The toilet seat cover according to claim 1, wherein a removable permeable panel covers the discharge outlet and facilitates retention of the filtration component within the air filtration chamber.

5. The toilet seat cover according to claim 1, wherein at least one battery communicates with the air moving device, a switch is provided for controlling a flow of electrical power from the at least one battery to the air moving device.

6. The toilet seat cover according to claim 5, wherein the switch includes a timer for controlling flow of electrical power, from the at least one battery to the air moving device, for a desired duration of time.

7. The toilet seat cover according to claim 6, wherein the desired duration of time is between about two minutes and about forty minutes.

8. The toilet seat cover according to claim 5, wherein each of the air moving device, the at least one battery and the switch are accommodated within a unitary housing which is located within the air intake chamber.

9. The toilet seat cover according to claim 5, wherein a removable access panel covers a lateral access opening which provides access to air intake chamber and at least one of the air moving device, the at least one battery and the switch.

10. The toilet seat cover according to claim 5, wherein a switch opening is provided in a bottom surface of the toilet seat cover to facilitate actuation of the switch.

11. The toilet seat cover according to claim 1, wherein the air moving device, during operation, displaces between 10 and 20 cubic feet per minute of air.

12. The toilet seat cover according to claim 1, wherein the filter member comprises activated charcoal.

13. The toilet seat cover according to claim 12, wherein the activated charcoal has an internal surface area of between about 300 and about 2,000 square meters per gram.

14. The toilet seat cover according to claim 5, wherein the switch controls the flow of electrical power from at least three batteries to the air moving device.

15. A method of providing an air treatment system in a toilet seat cover, the method comprising the steps of:

forming an internal compartment within the toilet seat cover;

providing an air inlet aperture in a bottom surface of the toilet seat cover for receiving air directly from an interior of a bowl of the toilet;

accommodating a filtration component within the internal compartment;

drawing in air directly from the interior of the bowl of the toilet, via an air moving device, into the internal compartment and supplying the drawn in air to the filtration component such that as the air passes through the filtration component, noxious odors in the air are removed prior to the air being discharged from a discharge outlet of the toilet seat cover into the surrounding environment wherein the internal compartment comprises an air intake chamber and an air filtration chamber and a passageway interconnecting the air intake chamber with the filtration chamber, the air inlet aperture communicates with the air intake chamber, such that between the interior of the bowl of the toilet and the air intake chamber, the air solely passes through the air inlet aperture and the air filtration chamber communicates with the discharge outlet, and the filtration component is accommodated within the air filtration chamber.

16. A toilet seat cover for a toilet, the toilet seat cover having opposed top and bottom surfaces and comprising:

an internal compartment located solely within the toilet seat cover;

an air inlet aperture being provided in the bottom surface of the toilet seat cover and directly communicating with the internal compartment, and, following installation of the toilet seat cover, the air inlet aperture, provided in the bottom surface of the toilet seat cover, direct communicating with an interior of a bowl of the toilet for receiving air directly from the bowl of the toilet;

a filtration component being accommodated within the internal compartment;

an air moving device for drawing in air, directly from the interior of the bowl of the toilet, in through the inlet aperture and conveying the air along the internal compartment;

the internal compartment including an internal passageway for channeling the drawn in air from the air moving device directly to an air permeable leading surface of the filtration component such that as the air passes through the filtration component, noxious odors in the air are removed prior to the air being discharged from a discharge outlet of the toilet seat cover into the surrounding environment; and the air permeable leading surface extends normal to the top and bottom surfaces of the toilet seat cover and directly faces the air moving device wherein the internal compartment comprises an air intake chamber and an air filtration chamber and the passageway interconnecting the air intake chamber with the filtration chamber, the air inlet aperture communicates with the air intake chamber, such that between the interior of the bowl of the toilet and the air intake chamber, the air solely passes through the air inlet aperture and the air filtration chamber communicates with the discharge outlet, and the filtration component is accommodated within the air filtration chamber.

17. The toilet seat cover according to claim 16, wherein the internal compartment being arranged such that the air is conveyed generally laterally and only the filtration component displaces the lateral conveyance of the air.

18. The toilet seat cover according to claim 16, wherein the air moving device is aligned within an air intake chamber of the internal compartment to convey the air laterally, directly at the air permeable leading surface of the filtration component.

19. The toilet seat cover according to claim 16, wherein the internal compartment is arranged such that the air only passes through the toilet seat cover, as the air is conveyed from the interior of the bowl of the toilet into the surrounding environment.

* * * * *